US007738670B2

(12) United States Patent
Kargus, IV

(10) Patent No.: US 7,738,670 B2
(45) Date of Patent: Jun. 15, 2010

(54) HIDDEN HANDS-FREE MICROPHONE WITH WIND PROTECTION

(75) Inventor: Walter A. Kargus, IV, Livonia, MI (US)

(73) Assignee: General Motors LLC, Detroit, MI (US)

( * ) Notice: Subject to any disclaimer, the term of this patent is extended or adjusted under 35 U.S.C. 154(b) by 1066 days.

(21) Appl. No.: 11/434,407

(22) Filed: May 15, 2006

(65) Prior Publication Data

US 2006/0204026 A1 Sep. 14, 2006

Related U.S. Application Data

(63) Continuation-in-part of application No. 10/893,478, filed on Jul. 16, 2004, now Pat. No. 7,369,664.

(51) Int. Cl.
*H04R 1/00* (2006.01)
*H04R 9/08* (2006.01)

(52) U.S. Cl. ..... 381/359; 381/365

(58) Field of Classification Search ..... 381/86, 381/359, 364, 365, 372; 181/205
See application file for complete search history.

(56) References Cited

U.S. PATENT DOCUMENTS 6,882,734 B2 * 4/2005 Watson et al. ..... 381/86

OTHER PUBLICATIONS

U.S. Appl. No. 11/345,967, filed Feb. 2, 2006, Kargus.

U.S. Appl. No. 10/850,303, Jul. 16, 2004, Kargus et al.

AKG Acoustics, A Harman International Company, Q500 Series, Q501T WS, Amplified Version With Improved Wind Screen, V2. May 1, 2004.

* cited by examiner

*Primary Examiner*—Brian Ensey

(57) ABSTRACT

A wind protection device for a microphone, the wind protection device including a body portion having a raised surface, a lower surface and a front face. The raised surface has a flow separation edge. The lower surface is offset from the raised surface the front face is bordered at a first edge by the flow separation edge and bordered at a second edge by the lower surface. The lower surface includes a recessed microphone holding area. Airflow separates from one of the raised surface or the flow separation edge, and the separated airflow is directed as one of recirculating airflow or a major airflow. The recirculating airflow is directed into a recirculation zone, and the major airflow is directed over a microphone zone and the recirculation zone to reduce the level of pressure fluctuations experienced by the microphone located in the recessed microphone holding area.

15 Claims, 7 Drawing Sheets

HIDDEN HANDS-FREE MICROPHONE WITH WIND PROTECTION

This is a continuation-in-part application of application Ser. No. 10/893,478 filed on Jul. 16, 2004, the entirety of which is incorporated by reference.

FIELD OF THE INVENTION

This invention relates generally to microphonic transducer systems, and more specifically to wind protection of hands-free microphones in mobile vehicles.

BACKGROUND OF THE INVENTION

Automobile manufacturers and designers have focused on airflow smoothening and efficient sound-insulating methods for reducing noise in the vehicle cabin. Noise sources such as the wind, turbulence, and pressure fluctuations can excite the vehicle body and transmit noise into the car cabin. Other inherent noises of the automotive environment include tire and engine noise, as well as voices of other passengers. Fans and blowers of the heating, ventilation, and air conditioning systems generate noise and also generate local pressure variations in the forced air stream. In some cases the pressure fluctuations produced by an airflow in a mobile vehicle can be 50 dB larger than the desired acoustic response, with a resultant signal to noise ratio at the microphone of −50 dB.

Besides being interested in finding ways to reduce the generation of turbulence, automotive manufacturers recognize the need to reduce the influence of the air pressure fluctuations inside a vehicle cabin upon various audio components such as a microphone of an in-vehicle cellular phone or a voice-recognition system.

In order to improve the signal to noise in a microphones exposed to airflow, some systems increase the active diameter of the diaphragm of the microphone thereby reducing the effects of the pressure fluctuations on the microphones.

Some of the newer automobile microphone systems use electronic processing, multiple microphones, or both to reduce the influence of the pressure fluctuations. These microphones can be located on rear-view mirrors, headliners, overhead consoles or steering columns.

In one example, an in-vehicle microphone system located in an overhead console picks up the driver's voice and uses algorithms in its electronic processing to reduce the influence of pressure fluctuations and reduce background noise. This electronic processing helps improve the transmission quality of the driver's speech.

In another example, a self-contained digital-signal-processing (DSP) microphone system uses a digital microphone array and software algorithms to help reduce voice recognition and audio intelligibility issues common in high noise, automotive environments.

Microphone systems for vehicles would be improved if the influence of airflow within the cabin was reduced and the system did not require multiple microphones or signal-processing software to electronically reduce the influence of pressure fluctuations produced by in-vehicle airflow, thereby increasing the signal-to-noise ratio and improving the fidelity of the microphonic pickups to improve clarity of speech. Therefore, an improved in-vehicle microphone system provides clearer voice recognition, increases speaker intelligibility, enhances other noise reduction techniques, and reduces packaging complexity, circuitry and costs, while reducing the influence of airflow around the vehicle cabin.

SUMMARY OF THE INVENTION

A first aspect of the present invention is a wind protection device for a microphone, the wind protection device including a body portion having a raised surface, a lower surface and a front face. The raised surface has a flow separation edge. The lower surface is offset from the raised surface. The front face is bordered at a first edge by the flow separation edge and is bordered at a second edge by the lower surface. The lower surface includes a recessed microphone holding area. Airflow separates from one of the raised surface or the flow separation edge, and the separated airflow is directed as one of recirculating airflow or a major airflow. The recirculating airflow is directed into a recirculation zone and the major airflow is directed over a microphone zone and the recirculation zone to reduce the level of pressure fluctuations experienced by the microphone located in the recessed microphone holding area.

A second aspect of the present invention is an acoustic system for a mobile vehicle. The system includes a microphone connected to an in-vehicle communication device and a wind protection device for the microphone. The wind protection device including a body portion having a raised surface, a lower surface and a front face. The raised surface has a flow separation edge. The lower surface is offset from the raised surface. The front face is bordered at a first edge by the flow separation edge and is bordered at a second edge by the lower surface. The lower surface includes a recessed microphone holding area. Airflow separates from one of the raised surface or the flow separation edge, and the separated airflow is directed as one of recirculating airflow or a major airflow. The recirculating airflow is directed into a recirculation zone and the major airflow is directed over a microphone zone and the recirculation zone to reduce the level of pressure fluctuations experienced by the microphone located in the recessed microphone holding area.

The foregoing and other features and advantages of the invention will become further apparent from the following detailed description of the presently preferred embodiment, read in conjunction with the accompanying drawings. The detailed description and drawings are merely illustrative of the invention rather than limiting, the scope of the invention being defined by the appended claims and equivalents thereof.

BRIEF DESCRIPTION OF THE DRAWINGS

Various embodiments of the present invention are illustrated by the accompanying figures, which are not necessarily to scale and in which like references indicate similar elements, and in which.

DETAILED DESCRIPTION OF THE PRESENTLY PREFERRED EMBODIMENTS

Figure 1:
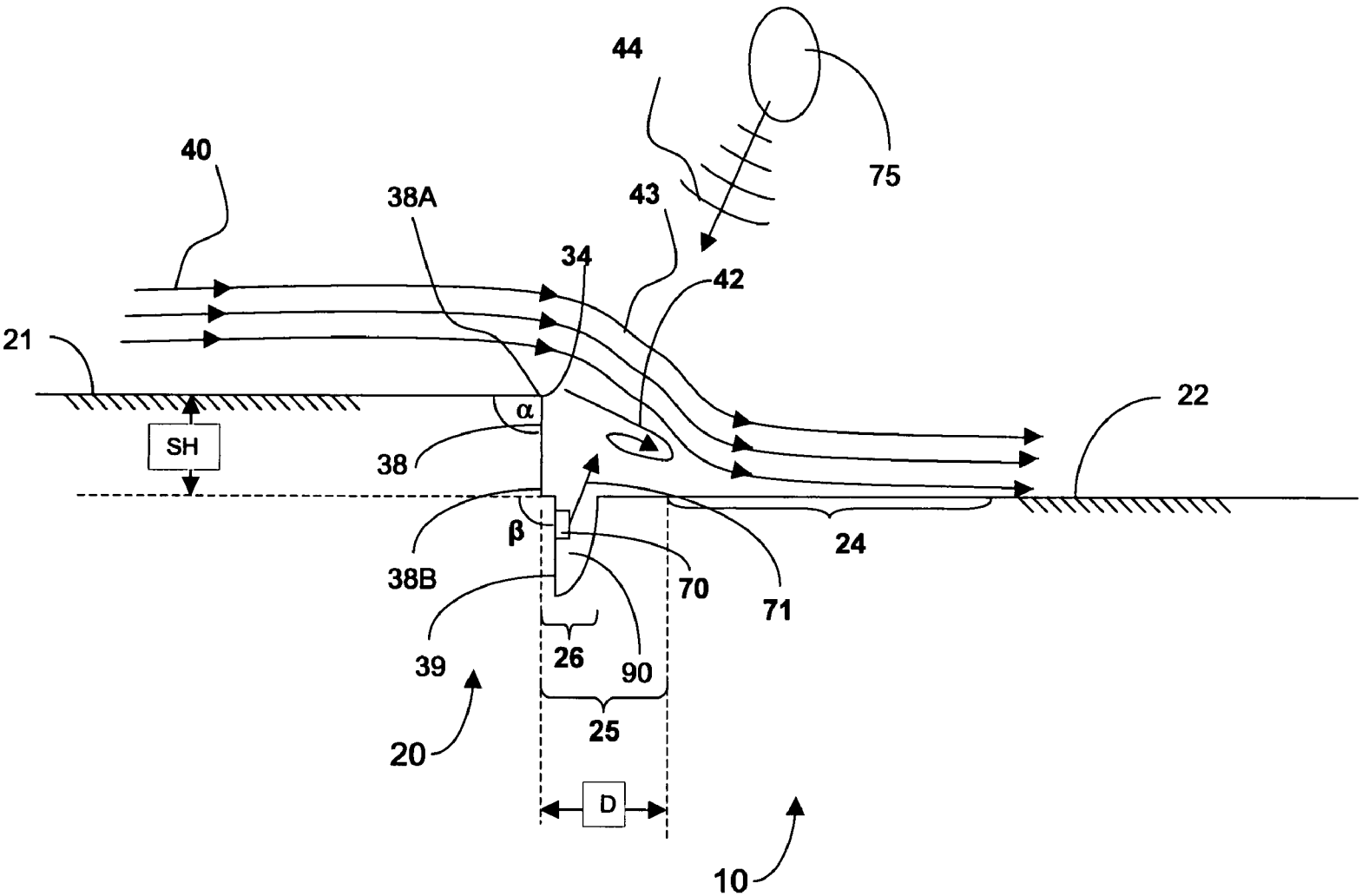
FIG. 1 illustrates a side cross-sectional view of a wind protection device for a microphone, in accordance with a first embodiment of the invention.
Figure 2:
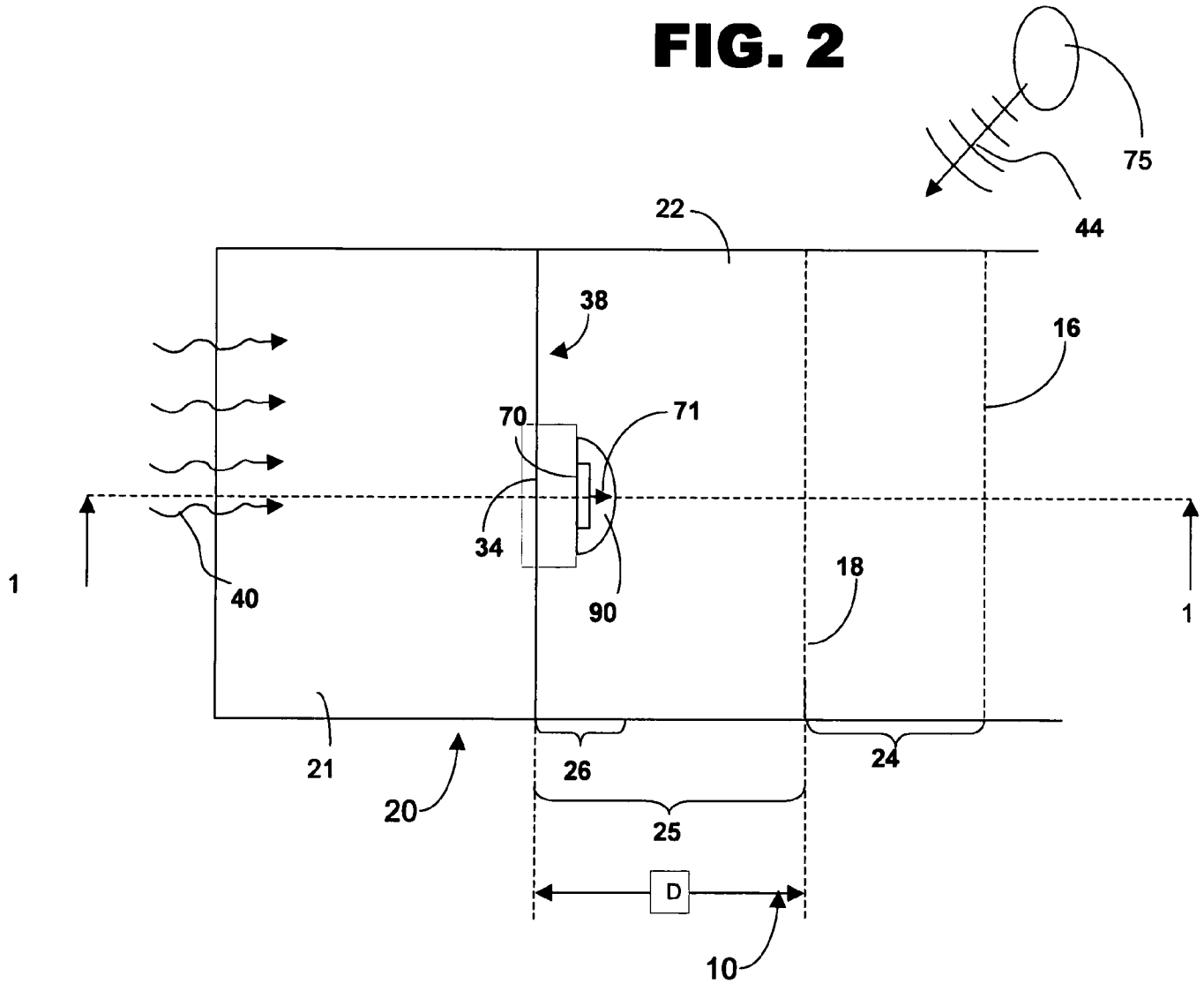
FIG. 2 illustrates a top view of the wind protection device for a microphone, in accordance with the first embodiment of the invention.

FIG. 1 illustrates a side cross-sectional view of a wind protection device 10 for a microphone 70, in accordance with a first embodiment of the invention. FIG. 2 illustrates a top view of the wind protection device 10, in accordance with the first embodiment of the invention. The plane upon which the cross-section view of FIG. 1 is taken is indicated by section line 1-1 in FIG. 2. A microphone 70 is located in the recessed microphone holding area 90 of the wind protection device 10. The wind protection device 10 includes a body portion 20. The body portion 20 includes a raised surface 21 having a flow separation edge 34, a lower surface 22 offset from the raised surface 21 by a step height SH (FIG. 1) and a front face 38 bordered at a first edge 38A (FIG. 1) by the flow separation edge 34 and bordered at a second edge 38B (FIG. 1) by the lower surface 22. The flow separation edge 34 is the apex of an $\alpha$ angle $\alpha$ between the front face 38 and the raised surface 21. The angle $\alpha$ has a range from greater than 0 degrees to about 180 degrees. In one embodiment, angle $\alpha$ is between 70 and 110 degrees. The vertex (angle) $\beta$ is between the microphone face 39 and the lower surface 22. The angle $\beta$ has a range from greater than 0 degrees to less than 360 degrees. In one embodiment the angle $\beta$ is between 70 to 110 degrees. The flow separation edge 34 is positioned downstream of the wind protection device 10.

The region of the lower surface 22 located between the second edge 38B of the front face 38 and the recirculation zone 25 includes the recessed microphone holding area 90 and the microphone zone 26. The recessed microphone holding area 90 is a recess in the lower surface 22 in the microphone zone 26. The recirculation zone 25 is located between the front face 38 and a recontact zone 24 and above the lower surface 22

The lower surface 22 is a lower border of the microphone zone 26, the recirculation zone 25 and the recontact zone 24.

The recirculation zone 25 includes a volume of space located between the front face 38 and recontact zone 24 and above the lower surface 22. The microphone zone 26 is located within the recirculation zone. The recessed microphone holding area 90 contains microphone 70 in the microphone zone 26.

A second plane (not shown) that is parallel to the end face 38 separates the recirculation zone 25 from the recontact zone 24. The intersection of the second plane with the lower surface 22 is indicated as the dashed line 18 (FIG. 2). The interface between the recirculation zone 25 and the recontact zone 24 is offset from the front face 38 by a recontact distance D. The recontact distance D is in the range of about 6 times the step height SH to about 8 times the step height SH, in one embodiment.

A third plane (not shown) that is parallel to the end face 38 is at the end of the recontact zone 24. The intersection of the third plane with the lower surface 22 is indicated as the dashed line 16 (FIG. 2). The recontact zone 24 includes a volume of space located above the lower surface 22 and between the recirculation zone 25 and the third plane.

The airflow 40 separates from either the raised surface 21 or the flow separation edge 34. The separated airflow is directed as one of recirculating airflow 42 (FIG. 1) or a major airflow 43 (FIG. 1). The major airflow 43 includes the majority of the separated airflow. The recirculating airflow 42 is the portion of separated airflow that is not included in the major airflow 43. The major airflow 43 is directed over the microphone zone 26 and the recirculation zone 25. The recirculating airflow 42 is directed into the recirculation zone 25 and is driven in a circular flow within the recirculation zone 25 by the major airflow 43 that contacts the adjacent region of the recirculating airflow 42. At least a portion of the major airflow 43 flows into the recontact zone 24. The recirculating airflow 42 is offset from the microphone 70 by the placement of the microphone 70 in the recessed microphone holding area 90.

In this manner, the wind protection device 10 reduces the level of pressure fluctuations experienced by the microphone 70 located in the recessed microphone holding area 90. The level of pressure fluctuations experienced by the microphone 70 located in the recessed microphone holding area 90 is reduced from the level of pressure fluctuations experienced by the microphone 70 when the microphone 70 is not located in the recessed microphone holding area 90 of the wind protection device 10.

Airflow 40 may be mechanically or naturally generated, such as from a blower fan from a defroster in an automobile, a heating, ventilation and air conditioning system, an open window of a moving vehicle, or an open roof of a convertible. Without the wind protection device, pressure fluctuations traveling with the airflow 40 and can interact with microphone 70 to generate a high audio noise signal that can swamp or diminish acoustic signals from, for example, a user's voice. Acoustic sound 44 generated from a source 75, such as a driver or a passenger in vehicle, is detected by microphone 70 with increased clarity due to diminished pressure fluctuation effects from airflow 40. Airflow 40 separates from raised surface 21 or flow separation edge 34 to reduce audio noise produced by pressure fluctuations in airflow 40 on the microphone 70.

Wind protection device 10 has the capability of positioning the microphone 70 in a desired orientation to increase the microphone signal to noise ratio. As shown in FIG. 1, microphone 70 has a directivity 71, which is parallel to the arrow labeled 71. The direction of propagation of the acoustic sound 44 is indicated by the arrow in the acoustic sound 44. To increase the signal to noise ratio of the microphone 70, the directivity 71 is oriented to be about parallel or anti-parallel to the direction of propagation of the acoustic sound 44. Thus, when the directivity 71 is perpendicular to the wave fronts of the acoustic waves of the acoustic sound 44, the signal to noise ratio of the microphone 70 is increased.

Depending on flow velocity and other factors, airflow 40 transiting the wind protection device 10 may separate from raised surface 21. Alternatively, flow separation may occur at flow separation edge 34 if separation has not occurred earlier. Flow separation generates vortices in the recirculation zone 25 that produces pressure fluctuations that are smaller that what is found in airflow 40. Pressure fluctuations experienced by microphone 70 are thereby reduced from the level of pressure fluctuations experienced by the microphone 70 if the microphone 70 is not in the recessed microphone holding area 90 of the wind protection device 10.

In one embodiment, recessed microphone holding area 90 is filled with open cell-foam.

Figure 3:
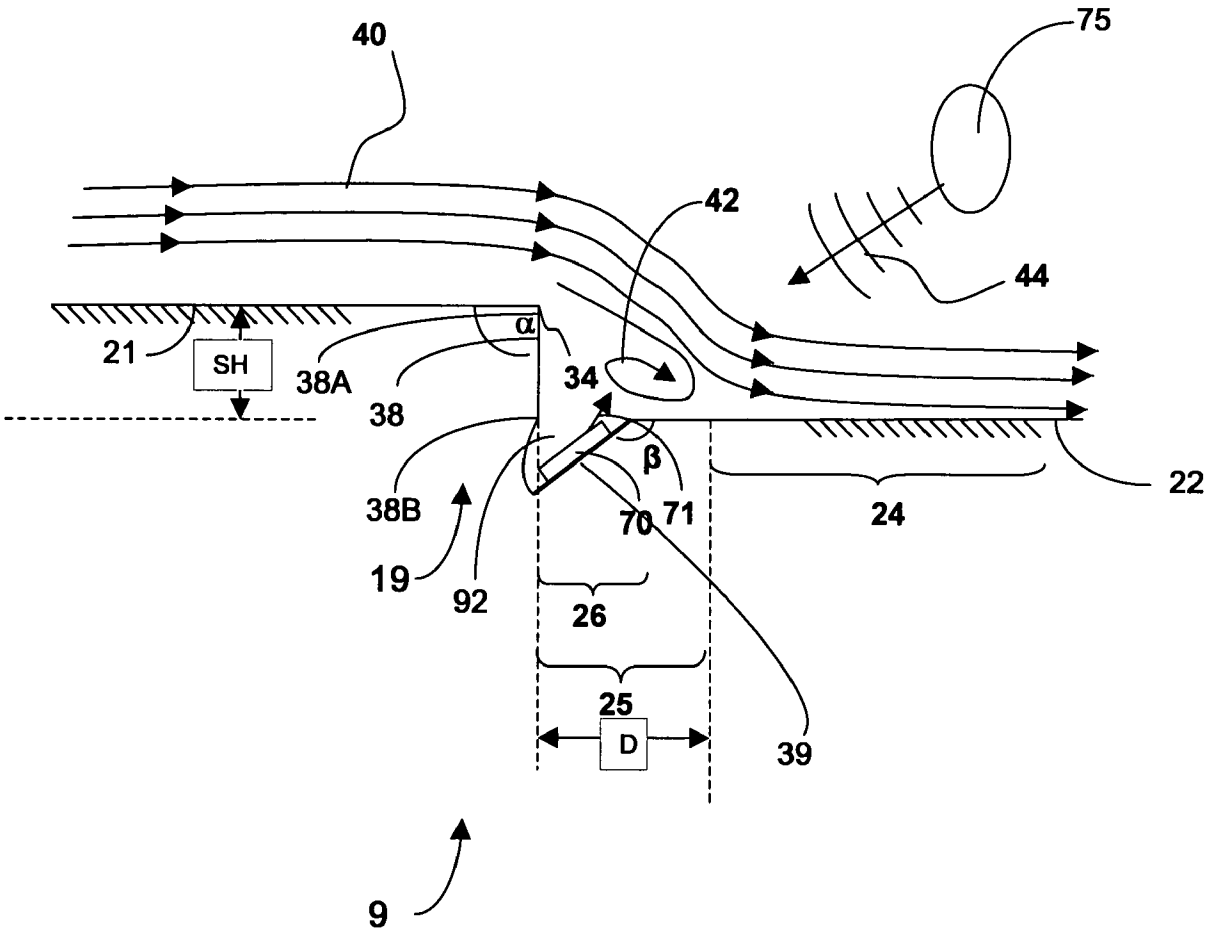
FIG. 3 illustrates a side cross-sectional view a wind protection device for a microphone, in accordance with a second embodiment of the invention.
Figure 4:
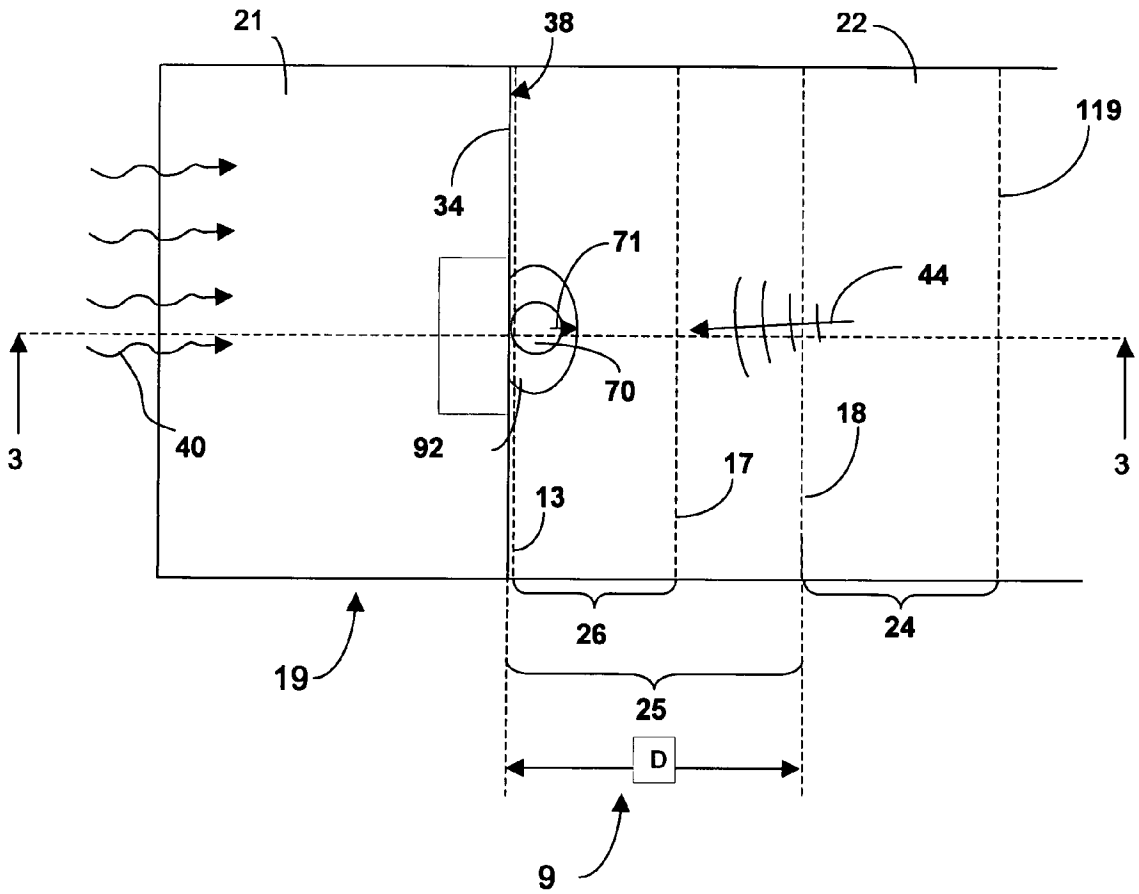
FIG. 4 illustrates a top view of the wind protection device for a microphone, in accordance with the second embodiment of the invention.

FIG. 3 illustrates a side cross-sectional view the wind protection device 9 for a microphone 70, in accordance with a second embodiment of the invention. FIG. 4 illustrates a top view of the wind protection device 9 for a microphone 70, in accordance with the second embodiment of the invention. The plane upon which the cross-section view of FIG. 3 is taken is indicated by section line 3-3 in FIG. 4.

The shape of the recessed microphone holding area 92 in wind protection device 9 differs from the shape of the recessed microphone holding area 90 in wind protection device 10. Recessed microphone holding area 92 is shaped to support and orient the microphone 70 in a different direction than recessed microphone holding area 90. In wind protection device 9, the microphone zone 26 partially overlaps the recirculation zone 25. In one embodiment, the microphone zone 26 completely overlaps the recirculation zone 25.

A microphone 70 is located in the recessed microphone holding area 92 of the wind protection device 9. The wind protection device 9 includes a body portion 19. The body portion 19 includes a raised surface 21 having a flow separation edge 34, a lower surface 22 offset from the raised surface 21 by a step height SH (FIG. 3) and a front face 38 bordered at a first edge 38A (FIG. 3) by the flow separation edge 34 and bordered at a second edge 38B (FIG. 3) by the lower surface 22.

A fourth plane (not shown) that is parallel to the end face 38 intersects the lower surface 22 at the line indicated as the dashed line 17 (FIG. 4). A fifth plane (not shown) that is parallel to the end face 38 intersects the lower surface 22 at the line indicated as the dashed line 13 (FIG. 4). A sixth plane (not shown) that is parallel to the end face 38 intersects the lower surface 22 at the line indicated as the dashed line 18 (FIG. 4).

The recirculation zone 25 includes a volume of space located between the front face 38 and recontact zone 24 and above the lower surface 22. The microphone zone 26 is located within the recirculation zone and above the lower surface 22 and is between the fourth plane indicated by dashed line 17 and the fifth plane dashed line 13. The recessed microphone holding area 92 contains microphone 70 in the microphone zone 26.

A seventh plane (not shown) that is parallel to the end face 38 is at the end of the recontact zone 24. The intersection of the seventh plane with the lower surface 22 is indicated as the dashed line 119 (FIG. 4). The recontact zone 24 includes a volume of space located above the lower surface 22 and between the recirculation zone 25 and the seventh plane indicated by dashed line 119.

The interface between the recirculation zone 25 and the recontact zone 24 is offset from the front face 38 by a recontact distance D. The recontact distance D is in the range of about 6 times the step height SH to about 8 times the step height SH.

Wind protection device 9 functions to reduce the level of pressure fluctuations experienced by the microphone 70 located in the recessed microphone holding area 92 in the same manner as the wind protection device 10 described above with reference to FIGS. 1-2. In one embodiment, recessed microphone holding area 92 is filled with open cell foam.

Figure 5:
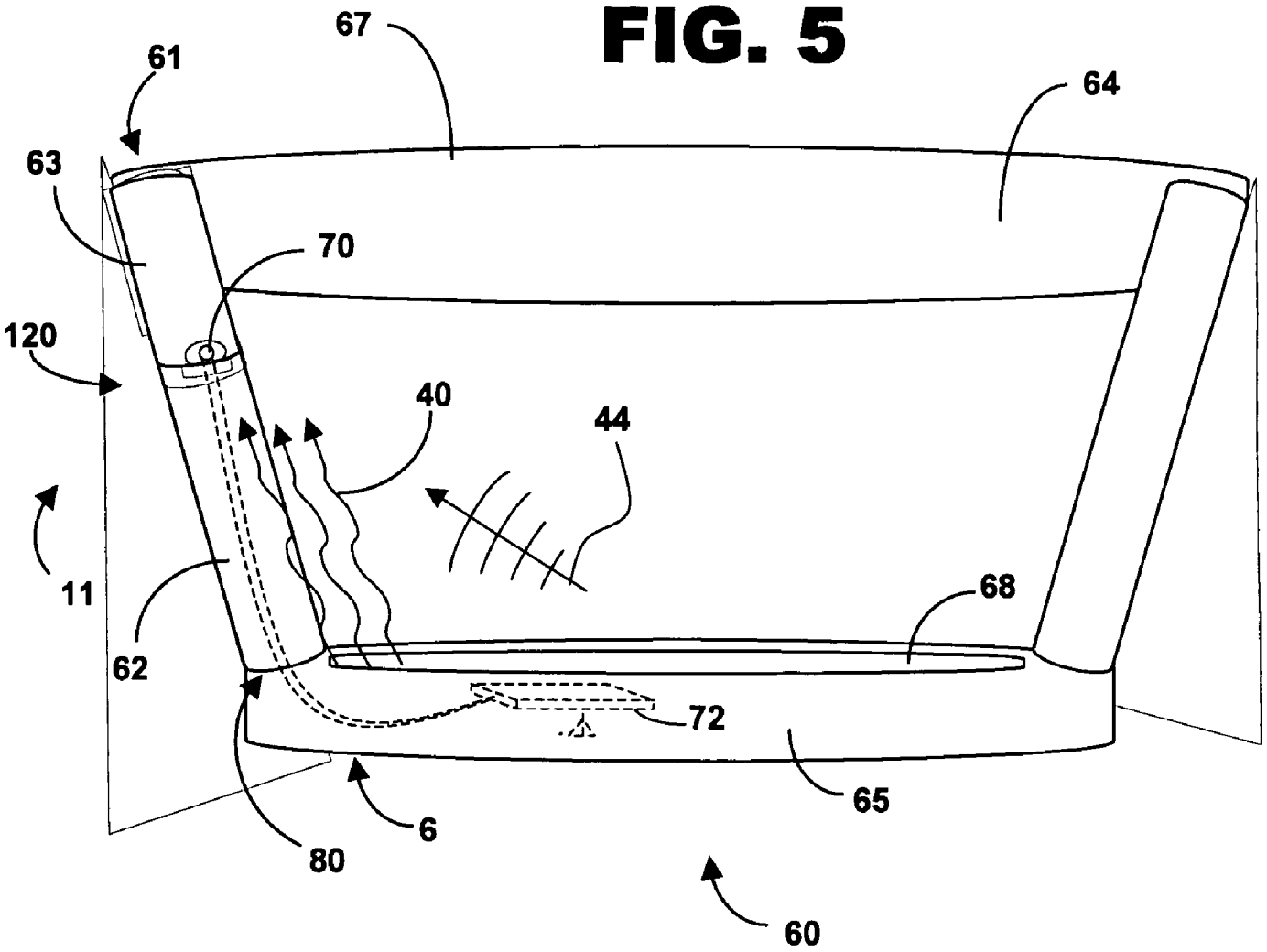
FIG. 5 illustrates an acoustic system for a mobile vehicle, in accordance with a third embodiment of the invention.
Figure 6:
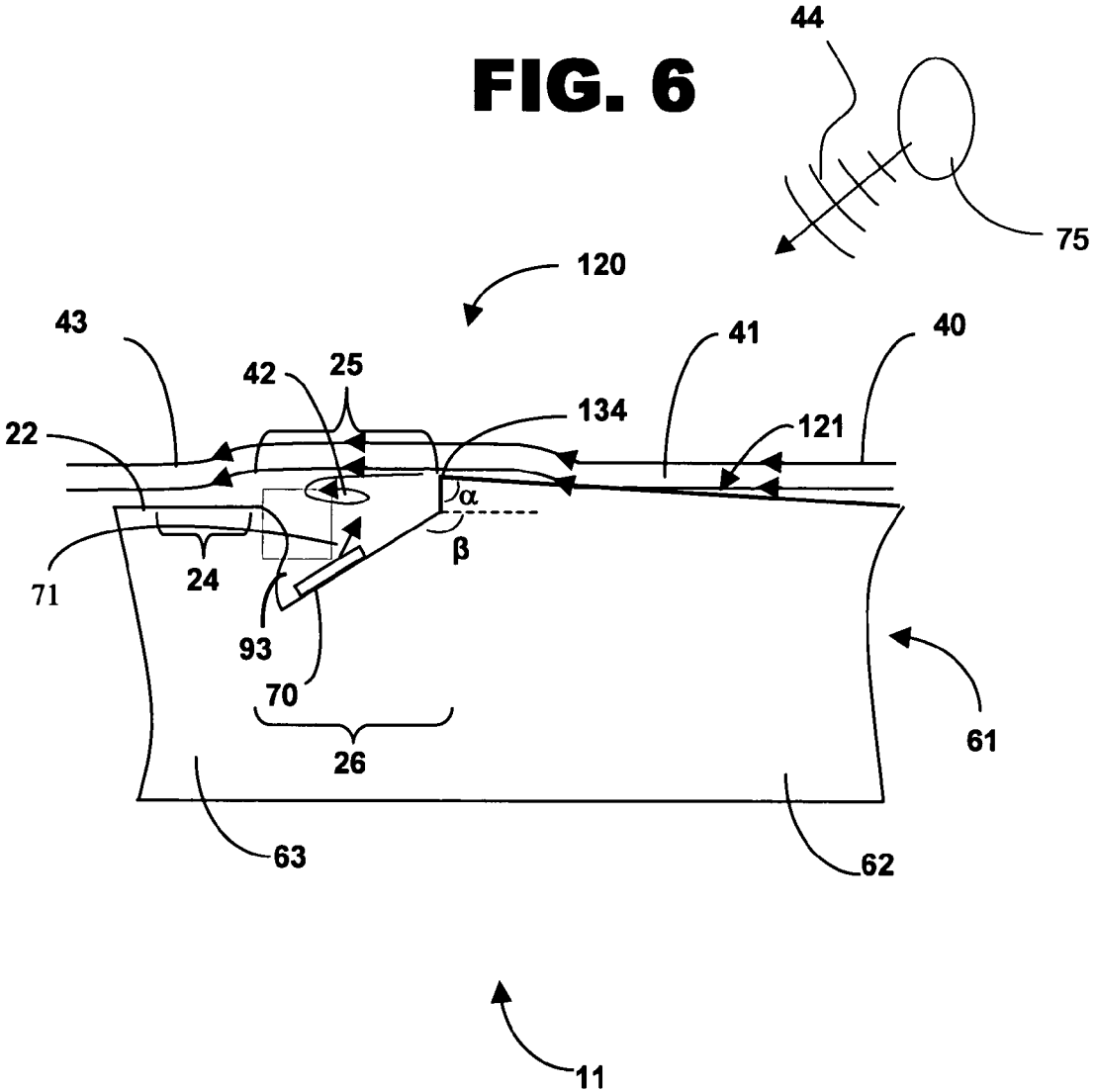
FIG. 6 illustrates an enlarged cross sectional view of the microphone and wind protection device in the acoustic system of FIG. 5.

FIG. 5 illustrates an acoustic system 6 for a mobile vehicle 60, in accordance with a third embodiment of the invention. Acoustic system 6 for a mobile vehicle 60 includes acoustic reception system 11 and in-vehicle communication device 72 electrically connected to microphone 70. The acoustic reception system 11 includes wind protection device 120 and microphone 70. FIG. 6 illustrates an enlarged cross sectional view of the microphone 70 and wind protection device 120 in the acoustic system 6 of FIG. 5.

The body portion of wind protection device 120 includes a raised surface 121, such as a surface of A-pillar 61 (FIG. 5). The flow separation edge 134 delineates the windward side 41 from the lee side 43 of the wind protection device 120. The recessed microphone holding area 93 containing microphone 70 is positioned to the lee side 43 of the flow separation edge 134 in the microphone zone 26. The wind protection device 120 diverts airflow 40 from the recessed microphone holding area 92. The recessed microphone holding area 92 contains microphone 70 in the microphone zone 26.

An airflow 40 generated within the mobile vehicle 60 is incident on a windward side 41 (FIG. 6) of the raised surface 121 forming wind protection device 120 and is not incident upon the lee side 43 (FIG. 6) of the raised surface 121 forming the wind protection device 120.

The windward side 41 of wind protection device 120 is a contoured outer surface which functions in the manner of raised surface 21 of wind protection device 10 described above with reference to FIGS. 1-2. In the acoustic reception system 11, the recessed microphone holding area 93 in which microphone 70 is located, is located to the lee of the raised surface 121 so the wind protection device 120 diverts airflow 40 from the microphone 70.

As shown in FIG. 6, the angle $\alpha$, described above with reference to FIG. 1, is less than 90 degrees. In one embodiment, the raised surface 121 is not pointed or angled but is a smooth curve. In another embodiment, the raised surface 121 is between the flow separation edge 134 and the bottom of A-pillar 80. In that case, the angle $\alpha$, described above with reference to FIG. 1, is less than 180 degrees and greater than zero degrees. In one embodiment, angle $\alpha$ is between 70 and 110 degrees. The angle $\beta$ has a range from greater than 0 degrees to less than 360 degrees. In one embodiment, angle $\beta$ is between 70 to 110 degrees.

The wind protection device 120 including the recessed microphone holding area 93 and the raised surface 121 can be positioned on any surface, such as a vehicle dashboard 65 or a roof rail 67 (FIG. 5). As illustrated in FIGS. 5-6, the microphone 70 and the wind protection device 120 are located on an A-pillar 61. In one embodiment, the wind protection device 120 is a protrusion 121 from the surface of the A-pillar 61 that demarks an upper pillar region 63 from a lower pillar region 62. The A-pillar 61 is a vehicle structure that is connected to the vehicle dashboard 65 at one end of the lower pillar region 62 and is connected to the roof rail 67 at one end of the upper pillar region 63. The A-pillar 61 borders one edge of the windshield 64. The wind protection device 120 can extend across the A-pillar 61. In one embodiment, the wind protection device 120 partially extends across a portion of the A-pillar 61 in the region bordering the microphone zone 26 (FIG. 6).

Microphone 70 is electrically connected to an in-vehicle communication device 72 (FIG. 5) through, for example, a cable, a wire harness, an in-vehicle network, or a vehicle bus. Examples of in-vehicle communication devices include a cell phone, a telematics unit, an entertainment system, and a voice-recognition system.

The airflow 40 from an air conditioning/defroster vent 68 may impinge upon the wind protection device 120. Wind protection device 120 functions in a similar manner as the wind protection device 10 as described above with reference to FIGS. 1-2.

Wind protection device 120 has the capability of positioning the microphone 70 in a desired orientation to increase the microphone signal to noise ratio. As shown in FIG. 6, microphone 70 has a directivity 71, which is parallel to the arrow labeled 71. The direction of propagation of the acoustic sound 44 is indicated by the arrow in the acoustic sound 44. To increase the signal to noise ratio of the microphone 70, the directivity 71 is oriented to be about parallel or anti-parallel to the direction of propagation of the acoustic sound 44. Thus, when the directivity 77 is perpendicular to the wave fronts of the acoustic waves of the acoustic sound 44, the signal to noise ratio of the microphone 70 is increased. Thus, acoustic sound 44 generated by a source 75, such as a driver or a passenger in vehicle 60, is detected by microphone 70 with increased clarity due to diminished pressure fluctuation effects from airflow 40 and the improved orientation.

In one embodiment, recessed microphone holding area 93 is filled with open cell foam.

Figure 7:
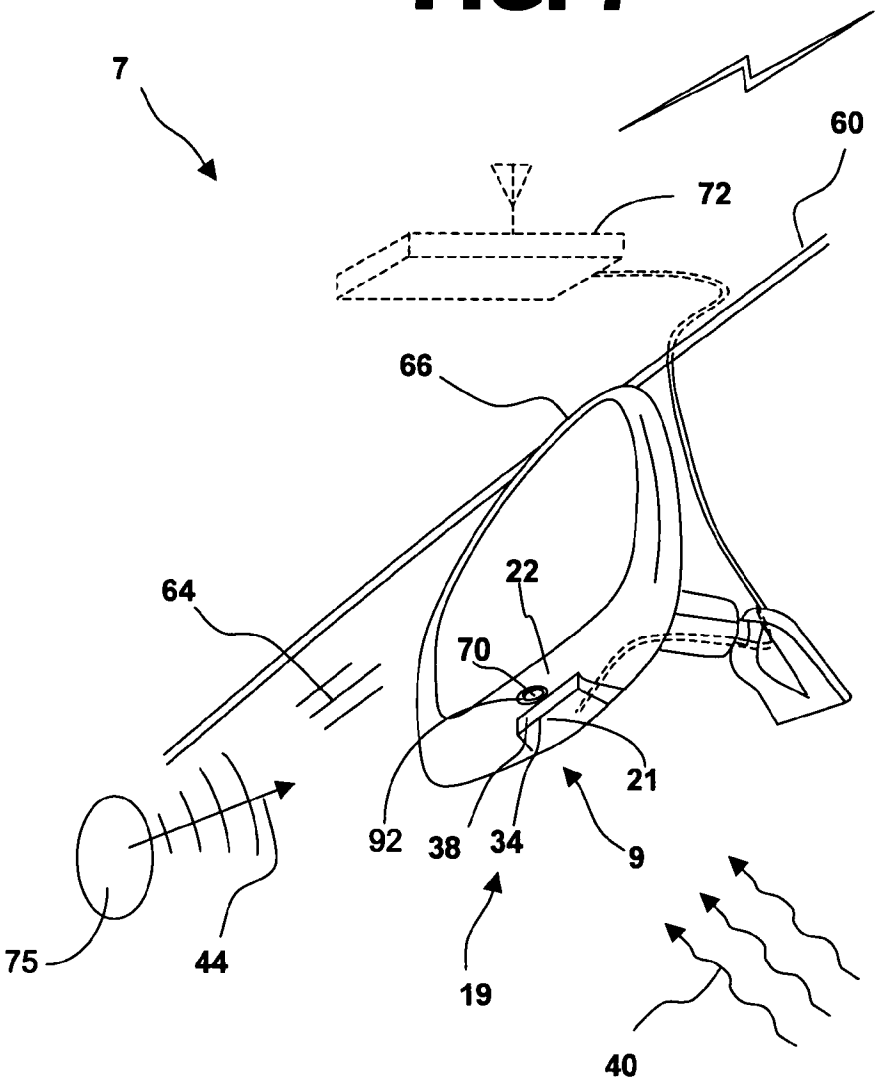
FIG. 7 illustrates an acoustic system for a mobile vehicle, in accordance with the first embodiment of the invention.

FIG. 7 illustrates an acoustic system 7 for a mobile vehicle 60 in accordance with the first embodiment of the present invention. Acoustic system 7 for a mobile vehicle 60 includes microphone 70, wind protection device 9 as described above with reference to FIGS. 3-4 and in-vehicle communication device 72 electrically connected to microphone 70. The wind protection device can be other embodiments, such as wind protection devices 20, 19 or 120.

As illustrated, wind protection device 9 and microphone 70 are positioned in a rearview mirror 66 attached to a windshield 64 of vehicle 60. Microphone 70 is electrically connected to in-vehicle communication device 72 through, for example, a cable, a wire harness, an in-vehicle network, or a vehicle bus. Examples of in-vehicle communication devices 72 include a cell phone, a telematics unit, an entertainment system, and a voice-recognition system. Although shown connected to rearview mirror 66, one or more microphones 70 with wind protection devices 9 may be connected to a steering wheel, a steering column, a vehicle dashboard, an entertainment console, an overhead console, a vehicle ceiling, a roof rail, an A-pillar in the vehicle, an in-vehicle console, other in-vehicle locations or combinations thereof. As used herein, the term telematics unit means any communication device configured to send and receive communications to and from a call center configured to provide services to a driver of the vehicle that includes the telematics unit.

An airflow 40 such as from a defroster may impinge upon microphone 70. A wind protection device 9 with a raised surface 21 and a flow separation edge 34 directs airflow 40 away from microphone 70 as described above with reference to FIGS. 3-4. For example, flow separation edge 34 generates recirculating flow in recirculation zone 25 to reduce the level of pressure fluctuations experienced by the microphone 70 from the airflow 40.

Wind protection device 9 includes the front face 38 at least partially bordered by flow separation edge 34. Front face 38 is positioned downstream of airflow 40. Acoustic sound 44 generated by source 75, such as a driver or a passenger in vehicle 60, is detected by microphone 70 with increased clarity due to diminished pressure fluctuation effects from airflow 40 and improved orientation of microphone 70 with the acoustic sound 44.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced there.

What is claimed is:

1. A wind protection device for a microphone, the wind protection device comprising:

a body portion including:

a raised surface having a flow separation edge;

a lower surface offset from the raised surface; and a front face bordered at a first edge by the flow separation edge and bordered at a second edge by the lower surface, wherein the lower surface includes a recessed microphone holding area, wherein airflow separates from one of the raised surface or the flow separation edge, wherein the separated airflow is directed as one of recirculating airflow or a major airflow, wherein the recirculating airflow is directed into a recirculation zone, and wherein the major airflow is directed over a microphone zone and the recirculation zone to reduce the level of pressure fluctuations experienced by a microphone located in the recessed microphone holding area.

2. The wind protection device of claim 1, wherein the flow separation edge partially borders the raised surface, wherein the region of the lower surface including the recessed microphone holding area and the microphone zone are located between the front face and a recontact zone, and wherein the recirculation zone is located between the microphone zone and the recontact zone.

3. The wind protection device of claim 2, wherein the lower surface is a lower border of the microphone zone, the recirculation zone and the recontact zone.

4. The wind protection device of claim 2, wherein the microphone zone and the recirculation zone at least partially overlap.

5. The wind protection device of claim 1, wherein the microphone has a directivity oriented to receive acoustic waves from a source.

6. The wind protection device of claim 5, wherein the microphone is a unidirectional microphone.

7. The wind protection device of claim 1, wherein the raised surface is offset from the lower surface by a step height, wherein the interface between the recirculation zone and the recontact zone is offset from the front face by a recontact distance, and wherein the recontact distance is in the range of about 6 times the step height to about 8 times the step height.

8. The wind protection device of claim 1, wherein the wind protection device is a protrusion from the lower surface, wherein the raised surface comprises a windward side of the wind protection device, wherein the front face comprises a lee side of the wind protection device, and wherein the flow separation edge delineates the raised surface from the front face along a length of the wind protection device.

9. An acoustic system for a mobile vehicle, the system comprising:

a microphone connected to an in-vehicle communication device; and a wind protection device for the microphone, the wind protection device comprising:

a body portion including a raised surface having a flow separation edge, a lower surface offset from the raised surface, and a front face bordered at a first edge by the flow separation edge and bordered at a second edge by the lower surface, wherein the lower surface includes a recessed microphone holding area, wherein airflow separates from one of the raised surface or the flow separation edge, wherein the separated airflow is directed as one of recirculating airflow or a major airflow, wherein the recirculating airflow is directed into a recirculation zone, and wherein the major airflow is directed over a microphone zone and the recirculation zone to reduce the level of pressure fluctuations experienced by the microphone located in the recessed microphone holding area.

10. The system of claim 9, wherein the flow separation edge partially borders the raised surface, wherein the region of the lower surface including the recessed microphone holding area and the microphone zone are located between the front face and a recontact zone, and wherein the recirculation zone is located between the microphone zone and the recontact zone.

11. The system of claim 10, wherein the microphone zone and the recirculation zone at least partially overlap.

12. The system of claim 9, wherein the microphone has a directivity oriented to receive acoustic waves from a source and wherein the raised surface is offset from the lower surface by a step height and the interface between the recirculation zone and the recontact zone is offset from the front face by a recontact distance and wherein the recontact distance is in the range of about 6 times the step height to about 8 times the step height.

13. The system of claim 9, wherein the in-vehicle communication device includes one of a cell phone, a telematics unit, an entertainment system, or a voice-recognition system.

14. The system of claim 9, wherein the microphone and the wind protection device are connected to one of a group consisting of a rearview mirror, a steering wheel, a steering column, a vehicle dashboard, an entertainment console, an overhead console, a vehicle ceiling, a roof rail, an A-pillar in the vehicle, an in-vehicle console, an in-vehicle location, and combinations thereof.

15. The system of claim 9, wherein the wind protection device is a protrusion from the lower surface, wherein the raised surface comprises a windward side of the wind protection device, wherein the front face comprises a lee side of the wind protection device, and wherein the flow separation edge delineates the raised surface from the front face along a length of the wind protection device.

* * * * *